United States Patent [19]

Jacobs et al.

[11] Patent Number: 4,958,103

[45] Date of Patent: Sep. 18, 1990

[54] HID LAMP WITH MULTIPLE DISCHARGE DEVICES

[75] Inventors: Cornelis A. Jacobs, Turnhout, Belgium; Norman R. King, Bath; Dale E. Bradham, Elmira, both of N.Y.

[73] Assignee: North American Philips Corp., New York, N.Y.

[21] Appl. No.: 289,281

[22] Filed: Dec. 21, 1988

[51] Int. Cl.[5] ..... H01J 61/34; H01J 61/54

[52] U.S. Cl. ..... 313/25; 313/1; 313/44; 313/634; 313/317

[58] Field of Search ..... 313/1, 25, 44, 113, 313/114, 634, 312, 317, 324

[56] References Cited

U.S. PATENT DOCUMENTS 2,103,029 12/1937 Davies ..... 313/25 X

FOREIGN PATENT DOCUMENTS 132373 10/1979 Japan ..... 313/25

*Primary Examiner*—Kenneth Wieder

*Attorney, Agent, or Firm*—Emmanuel J. Lobato

[57] ABSTRACT

A high intensity discharge lamp having a pair of discharge devices with one of them initially operative. The discharge devices are laterally adjacent with the higher temperature end of the operative discharge device proximate the lower temperature end of the inoperative discharge device for heating it during lamp operation. This facilitates starting of the inoperative discharge device after a momentary power interruption.

12 Claims, 2 Drawing Sheets

HID LAMP WITH MULTIPLE DISCHARGE DEVICES

BACKGROUND OF THE INVENTION

The present invention relates to high intensity discharge lamps having multiple discharge devices, and more particularly to such lamps having improved lumen recovery upon restarting.

High intensity discharge electric lamps (HID lamps) have found a wide range of applications. These lamps are efficient, they can be made in a wide range of wattages and they have long operating lives. One disadvantageous characteristic of HID lamps; however, is their failure to instantly restart after a momentary power interruption.

HID lamps generally include a discharge device comprising a discharge vessel containing a pair of internal spaced discharge electrodes, and a small quantity of vaporizable and ionizable material referred to as the fill material. Typically, the fill material is a sodium mercury amalgam, and it may also contain other materials such as metal halides. In operation, some of the fill material is vaporized and the voltage applied across the discharge electrodes maintain an electrical discharge through the vaporized material, which is partially ionized. The high temperature vaporized and partially ionized material emits visible light.

A disadvantage inherent in HID lamps is their inability to restart immediately after a momentary power interruption. When the fill material within the discharge vessel has been partially vaporized the internal pressure within the discharge vessel increases to greater than one atmosphere. This pressure increase will result in a higher voltage being required in order to initiate a discharge than in the case of the lamp being started at a lower internal pressure. As a consequence, if power is momentarily interrupted the lamp will have to cool somewhat and the internal pressure of the discharge vessel will have to decrease before discharge can be reestablished.

In order to overcome the delay in restarting inherent in HID lamps, such lamps have been made with multiple discharge devices. U.S. Pat. No. 4,287,454 (Feuersanger et al) discloses HID lamps having a pair of discharge devices connected electrically in parallel. When a starting voltage is applied to this lamp one of the discharge devices starts operating, and its internal pressure rises. If lamp power is momentarily interrupted the starting voltage of the previously operating discharge device will now be too high to allow it to instantly restart. The previously inoperative discharge device, however, will not have a substantially elevated internal pressure so that the reapplied power will cause the latter discharged device to start.

The properties of high pressure sodium lamps having two discharge devices are explored in an article by R.M. Kane and N.R. King, "A 400-W Instant Restrike Double Arc Tube HPS Lamp", Lighting Design + Application, Dec. 1986, pages 31–35. The article examines the ability of an HPS lamp having two discharge devices to restart after a momentary power interruption, to promptly recover lumen output and to develop good light distribution. Because of the presence of a second inoperative discharge device, significant shadowing can occur in the light distribution from the lamp. The principal lamp parameter investigated was the spacing between discharge devices, and its affect upon lamp restarting, lumen recovery and light distribution.

The article shows that there are advantages to closely spacing the two discharge vessels within the lamp. The operative discharge vessel can be used to preheat the inoperative one somewhat. Thus, upon restarting the previously inoperative discharge device will take less time to warm up after restarting. On the other hand, the closer the discharge devices the less likely that the lamp will restart after a second power interruption that shortly follows a first interruption. Moreover, shadowing of the operative discharge device by the inoperative discharge device becomes more severe the closer the discharge devices are spaced.

It would be desirable to provide for some preheating of the inoperative discharge device to improve lumen recovery upon restarting, but without having to space the discharge devices so close as to diminish the restart characteristics or create an intolerable degree of shadowing.

SUMMARY OF THE INVENTION

According to the invention a high intensity electric discharge lamp is comprised of an outer envelope and a pair of elongated discharge devices within the outer envelope. Means is provided for applying a voltage to operate one of the discharge devices.

Each of the discharge devices has one end that operates at a higher temperature than the other end. Mounting means is provided for mounting the discharge devices with the higher temperature operating end of one of them proximate the lower temperature operating end of the other discharge device, for heating the lower temperature operating end of the other discharge device when it is inoperative.

DETAILED DESCRIPTION OF THE INVENTION

Figure 1:
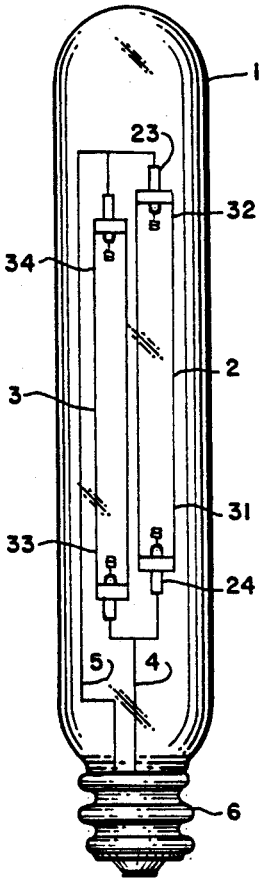
FIG. 1 illustrates an HID lamp according to the invention.

The embodiment of the lamp according to the invention shown in FIG. 1 is a high pressure sodium discharge lamp having an outer envelope 1 containing a pair of discharge devices 2, 3. The discharge devices 2, 3 are mounted within the outer envelope 1 by conventional frame structure like that shown in U.S. Pat. No. 4,287,454 (Feuersanger et al) or 4,689,518 (N.R. King). The frame structure is shown schematically in FIG. 1.

Conductive supports 4 and 5 are respectively connected to the opposite ends of the two discharge devices 2 and 3 and constitute mounting means for mounting the discharge devices. The conductive supports 4, 5 are also connected to respective contacts of the lamp base 6. When a lamp starting voltage is applied to the lamp base 6, the starting voltage is applied across both of the discharge devices 2 and 3. One of them starts, and as it becomes conductive its impedance decreases to affectively short-circuit the other discharge device. Thus, only one of the discharge devices 2, 3 is rendered operative. The structure described up to now is conventional.

Figure 2:
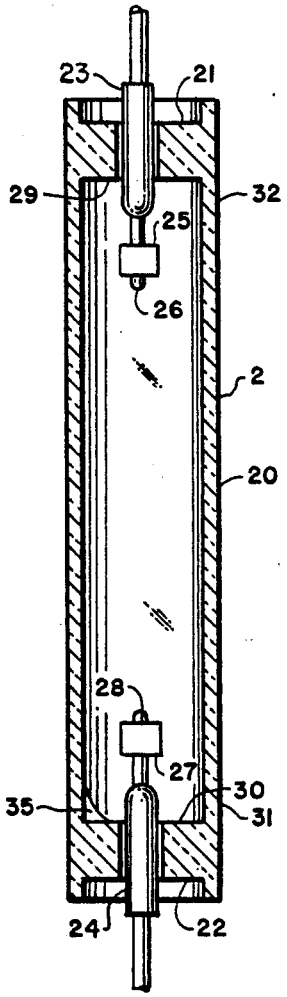
FIG. 2 is a longitudinal section of a discharge device used in the HID lamp according to the invention.

The discharge device 2 is shown in longitudinal section in FIG. 2. The discharge device 3 has a structure identical to that of the discharge device 2.

The discharge device is comprised of a discharge vessel in the form of a tubular ceramic body 20 having sintered end closures 21, 22 so as to constitute a monolithic structure with the tubular body 20. Each of the end closures 21, 22 has a central aperture for receiving a niobium feedthrough 23, 24. The niobium feedthroughs are tubular and each has an open end external to the discharge device and a closed end within the discharge device. A corresponding discharge electrode 25, 27 is mounted on the closed end of the respective feedthrough 23, 24. Each discharge electrode terminates at a respective tip end 26, 28 facing the other discharge electrode and spaced apart to define a discharge gap between them.

A quantity of a sodium mercury amalgam 35 is contained within the discharge device. Also contained within the discharge device is a rare gas such as xenon at a pressure of around 10 to 400 Torr and preferably 15 to 30 Torr. In operation, a voltage is applied across the feedthroughs 23 and 24 by the conductive supports 4 and 5. This voltage causes an electric discharge between the electrodes 25 and 27 in the rare gas. The consequent heating of the rare gas vaporizes the sodium mercury amalgam 35. The electrical discharge causes partial ionization of the vaporized mercury and sodium and the emission of intense light in the visible region of the spectrum, particularly by the sodium.

The ends of a discharge device have the lowest temperature during operation. As a result the excess amalgam is located there during lamp operation, and when the lamp stops operating and a discharge device begins cooling, condensation of the mercury vapor and sodium vapor occurs in the region of the ends of the discharge vessel. An important aspect of the present invention is that the discharge device is constructed so that one end of the discharge vessel operates at a lower temperature than the other and condensation of the sodium and mercury vapor will occur at the lower temperature end.

The temperature of each of the discharge vessel ends is determined by the distance between the discharge electrode and its adjacent end wall. More particularly, the distance between the electrode tip end 26 and the inner facing end wall 29 (referred to as the mount height) is a good measure of the effective distance that determines end temperature. Typical mount heights for 250 to 400 watt high pressure sodium lamps are of the order of 11 to 14 millimeters. By making the distance between the electrode tip 26 and the wall 29 just one or two millimeters shorter than the distance between the electrode tip 28 and the wall 30 one can ensure that the sodium and mercury condense at the wall 30 end of the discharge vessel.

In the following discussion the region 31 of the discharge device will be referred to as the lower temperature end and the region 32 will be referred to as the higher temperature end of the discharge device 2.

The relative positions of the lower and higher temperature ends of the discharge devices 2 and 3 are shown in FIG. 1. Discharge device 2 has low temperature end 31 and high temperature end 32. Discharge device 3 has high temperature end 33 and low temperature end 34. The two discharge devices are positioned adjacent and parallel, and are relatively offset lengthwise so that their respective lower temperature ends 31 and 34 are adjacent higher temperature regions of the opposite discharge devices.

The purpose of the offset structure is to position the condensed amalgam of the inoperative discharge device opposite a higher temperature region of the operative discharge device to enhance preheating of the condensed amalgam. Thus, when the inoperative discharge device becomes operative after a power interruption the preheated amalgam will have to undergo a smaller temperature rise in order to vaporize than if there had been no preheating. This will shorten the lumen recovery time of the discharge device that becomes operative after a power interruption.

Figure 3:
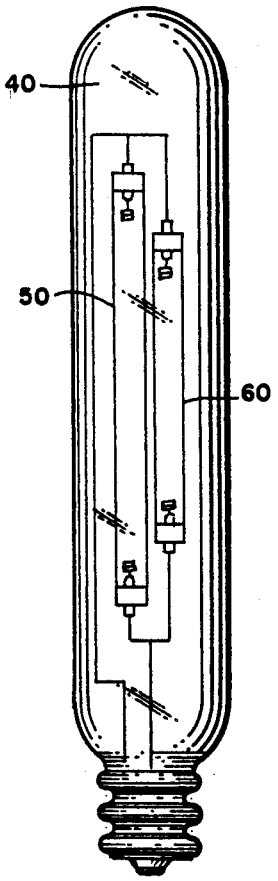
FIG. 3 and FIG. 4 illustrate further embodiments of the HID lamp according to the invention.

Another embodiment of the invention shown in FIG. 3 is comprised of an outer envelope 40 containing discharge devices 50 and 60. Both of the discharge devices 50 and 60 are comprised of respective tubular bodies having internal discharge electrodes as previously described. The discharge device 50 is longer that the discharge device 60. The shorter discharge device 60 is positioned with both of its ends opposite regions of the discharge device 50 that have a higher operating temperature than its lower temperature end. There is no requirement for an asymmetrical design to force the lower temperature ends of the discharge devices 50 and 60 to occur at particular relative positions. No matter where the mercury and sodium vapor condenses in the discharge device 60 it will be opposite a region of the device 50 that operates at a higher temperature than its lower temperature end. Thus, preheating of the amalgam in the discharge device 60 will be enhanced.

In the embodiment shown in FIG. 3 the larger discharge device 50 should start first. Preferential starting can be achieved by the means disclosed in prior pending application Ser. No. 846,424 filed Mar. 31, 1986 (C.A. Jacobs), now U.S. Pat. No. 4,788,475 issued on Nov. 29, 1988. The Jacobs patent discloses that the pressure of the rare starting gas within the discharge device 50 can be selected so that the device 50 always starts first or an auxiliary wire proximate the discharge device 50 may be provided to start it first.

Because of its smaller size and position relative to the larger discharge device 50, the amalgam within the discharge device 60 will be continually preheated and in the event of a momentary power interruption the discharge device 60 will start upon reapplication of the interrupted power. Moreover, the amalgam within the discharge device 60 will be preheated irrespective of where it had condensed within the discharge device 60.

Still another technique for forcing the high temperature end of one discharge device to occur opposite the lower temperature end of the other is to provide a reflective metal band at the end of the discharge device which is to have a higher temperature. The reflective metal band reduces the thermal radiation from the discharge device end where it is mounted, and the reduced thermal radiation causes that end of the discharge device to operate at a higher temperature than if no reflective band were present. Such a metal reflective band is shown in U.S. Pat. No. 4,559,473 (C.I. McVey) on a lamp having a single discharge device and could be incorporated in a dual discharge device lamp of the prior art type in order to practice the invention.

Figure 4:
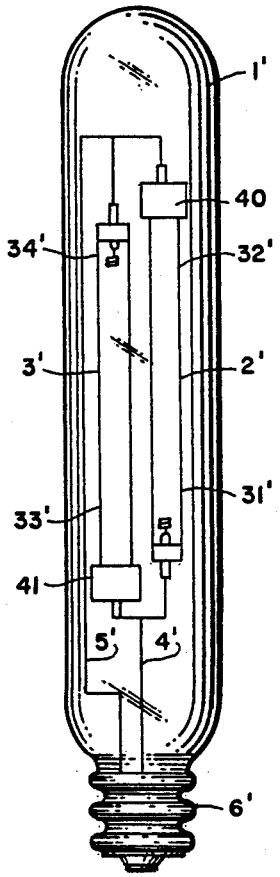

FIG. 4 illustrates the use of reflective metal bands in the lamp according to the invention shown in FIG. 1. Corresponding parts of the two lamps are identified by the same reference numeral, but with a prime in FIG. 4 to distinguish between the two embodiments. The two discharge devices 2', 3' each have a respective reflective metal band 40, 41 at their corresponding higher temperature end regions 32' and 33'. Thus, the higher temperature region 32' of the discharge device 2' is adjacent the lower temperature region 34' of the discharge device 3', and the higher temperature region 33' is adjacent the lower temperature region 31'. Consequently, the higher temperature end of the operating discharge device will be positioned to preheat the amalgam within the inoperative discharge device in order to accelerate the rise in light output when the inoperative discharge device is turned on.

The illustrated embodiments of the invention are high pressure sodium discharge lamps. The invention is not limited to this type of lamp, however, but may be applied to lamps which also contain metal halides for influencing the spectrum of their output light, and lamps having quartz or hard glass discharge vessels. Accordingly, the disclosed preferred embodiments should be taken as exemplary and not exhaustive, and the scope of the invention is determined by the following claims.

What is claimed:

1. In a high intensity electric discharge lamp having an outer envelope, a pair of elongated discharge devices within said outer envelope, and means for applying a voltage to initially operate one of said discharge devices and to operate the other of said discharge devices after a momentary power interruption during lamp operation and the previously operative discharge device fails to restart, the improvement comprising:

each of said discharge devices having one end operative at a higher temperature than the other end; and mounting means for mounting said discharge devices laterally adjacent to each other with the higher temperature end of one proximate the lower temperature end of the other discharge device for heating the lower temperature end of an inoperative discharge device with the higher temperature end of the operative discharge device to facilitate starting of the inoperative discharge device.

2. In a high intensity discharge lamp according to claim 1, each of said discharge devices are high pressure sodium discharge devices comprised of an elongated tubular ceramic tubular discharge vessel having a pair of opposite ends, a pair of discharge electrodes disposed within said tubular discharge vessel each at a respective end of said tubular discharge vessel, and a respective electrode feedthrough each mounting a discharge electrode a predetermined distance from the respective end of said discharge vessel, and the electrode feedthrough proximate the higher temperature end of a discharge vessel being effective for mounting the corresponding discharge electrode closer to the higher temperature end of said discharge vessel than the other discharge electrode proximate the lower temperature end of said discharge vessel.

3. In a high intensity discharge lamp according to claim 2, wherein said mounting means is effective for mounting said discharge devices parallel and spaced from each other laterally, and relatively positioned lengthwise with the electrode of the higher temperature end of one of said discharge devices opposite the lower temperature end of the other of said discharge vessels.

4. In a high intensity discharge lamp according to claim 3, wherein said discharge devices are comprised of tubular discharge vessels having substantially equal lengths, and said mounting means is effective for mounting each said discharge device with its respective electrode at the higher temperature end opposite the lower temperature end in the opposite discharge vessel.

5. In a high intensity discharge lamp according to claim 4, further comprising means for preferentially starting one of said discharge devices.

6. In a high intensity discharge lamp according to claim 2, wherein said discharge devices each comprise a thermally reflective metal band disposed around the higher temperature operating end thereof and defining a heat reflector, and said mounting means is effective for mounting said discharge devices with each end having a heat reflector adjacent the end of the other which is free of a heat reflector.

7. In a high intensity discharge lamp according to claim 2, wherein said discharge devices are comprised of tubular discharge vessels having unequal lengths, and said mounting means is effective for mounting said discharge devices parallel and spaced from each other laterally, and relatively positioned lengthwise with the shorter discharge device wholly opposite a high temperature region of said longer discharge device.

8. In a high intensity discharge lamp according to claim 7, further comprising means for preferentially starting the longer of said discharge devices.

9. In a high intensity electric discharge lamp having an outer envelope, a pair of elongate discharge devices within said outer envelope, and means for applying a voltage to initially operate a first of said discharge devices and to operate the second of said discharge devices after a momentary power interruption occurs during lamp operation and the initially operated first discharge device fails to restart, the improvement comprising:

said first elongate discharge device having a particular length, a pair of opposite ends which exhibit the lowest operating temperature of said first discharge device, and an intermediate region between said pair of opposite ends which exhibits operating temperatures greater than the lowest end temperature;

said second discharge device having a length less than the length of said first discharge device; and mounting means for mounting said discharge devices adjacent and parallel with the entire length of said shorter second discharge device opposite said intermediate portion of said longer first discharge device and for mounting said discharge devices to preheat said shorter second discharge device in its inoperative condition by said intermediate portion of said longer first discharge having higher operating temperature than said ends of said first discharge device.

10. In a high intensity electric discharge lamp according to claim 9, wherein said discharge devices are high pressure sodium discharge devices.

11. In a high intensity electric discharge lamp according to claim 10, further comprising means for preferentially starting said first longer discharge device.

12. In a high intensity electric discharge lamp according to claim 9, further comprising means for preferentially starting said first longer discharge device.

* * * * *